US005685422A

United States Patent [19]

Kim

[11] Patent Number: 5,685,422

[45] Date of Patent: Nov. 11, 1997

[54] TWO-COMPONENT MIXING PACKAGE

[75] Inventor: Hyeong Sook (Morin) Kim, Tsimshatsui, Hong Kong

[73] Assignee: Georg Wiegner, Kowloon, Hong Kong

[21] Appl. No.: 408,598

[22] Filed: Mar. 22, 1995

[30] Foreign Application Priority Data

Mar. 22, 1994 [DE] Germany ..... 44 09 696.8

[51] Int. Cl.[6] ..... B65D 25/08

[52] U.S. Cl. ..... 206/222

[58] Field of Search ..... 206/219, 220, 206/221, 222, 568

[56] References Cited

U.S. PATENT DOCUMENTS

| | | | |
|---|---|---|---|
| 3,220,588 | 11/1965 | Lipari | 206/222 |
| 3,344,914 | 10/1967 | Bloom et al. | 206/222 |
| 3,347,410 | 10/1967 | Schwartzman | 206/222 X |
| 3,537,605 | 11/1970 | Solowey | 206/222 |
| 3,548,562 | 12/1970 | Schwartzman | 206/222 X |
| 3,802,604 | 4/1974 | Morane et al. | 206/222 X |
| 4,067,440 | 1/1978 | Lataix | 206/222 |
| 4,103,772 | 8/1978 | Wiegner | 206/222 |
| 4,179,035 | 12/1979 | Wiegner | 206/222 |
| 4,247,001 | 1/1981 | Wiegner | 206/222 |
| 4,465,183 | 8/1984 | Saito et al. | 206/222 |
| 4,682,689 | 7/1987 | Pereira et al. | 206/222 |
| 5,170,888 | 12/1992 | Goncalves | 206/222 |
| 5,409,141 | 4/1995 | Kikuchi et al. | 206/221 X |

*Primary Examiner*—Bryon P. Gehman

*Attorney, Agent, or Firm*—Steven F. Caserza; Flehr, Hohbach, Test, Albritton & Herbert

[57] ABSTRACT

Container for storing two different substances, having a first compartment containing a liquid, a second compartment containing another liquid, a separating body which separates the two compartments, and a tool which breaks the separating body when required and can be moved by hand by means of at least one transmitting part which transmits compression forces, such that the force-transmitting direction of the transmitting part 5 lies at an angle to the direction of movement 6 of the tool 4, and that the transmitting part 5 is rotatably attached by one of its ends to the tool 4 and by its other end to the inside wall 9 of the container.

9 Claims, 3 Drawing Sheets

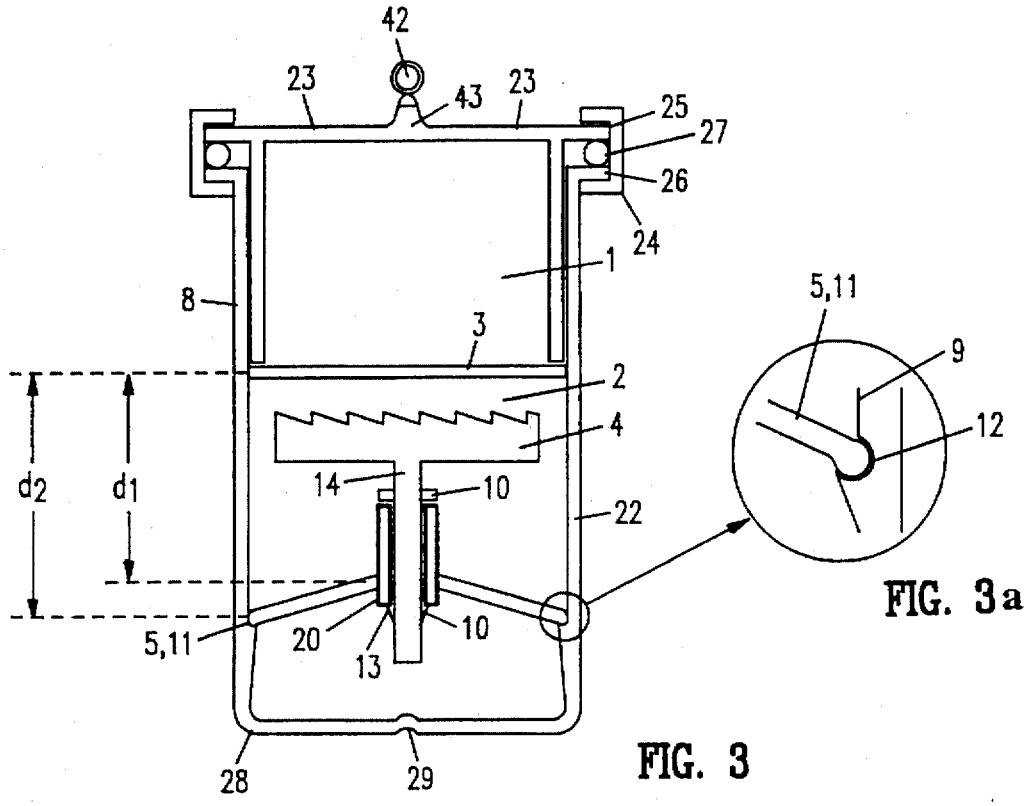
FIG. 3a
FIG. 3
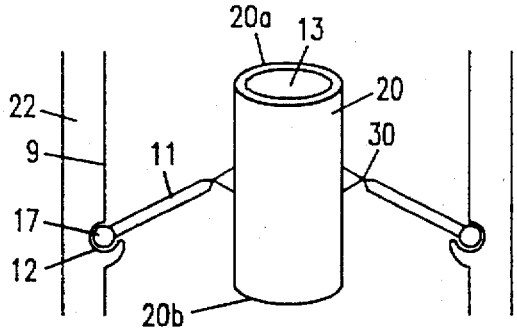
FIG. 4
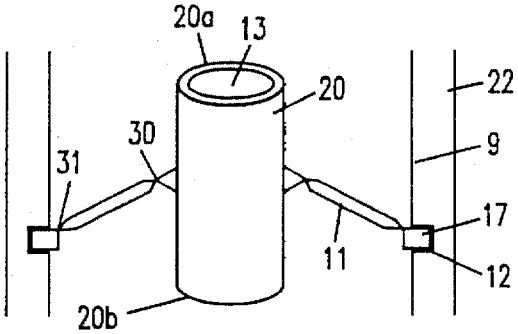
FIG. 5
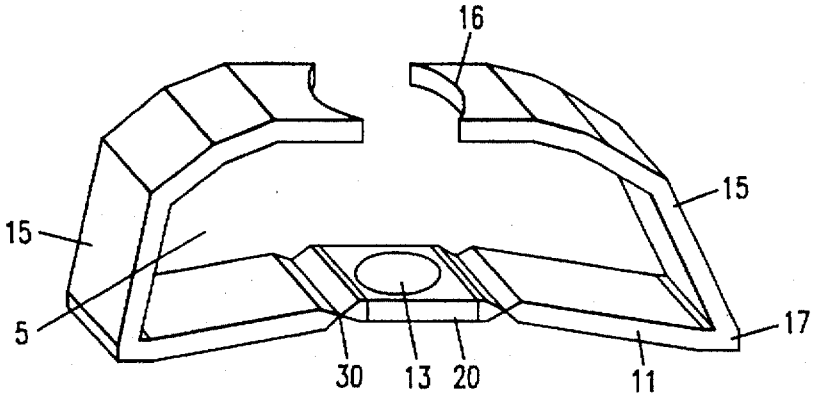
FIG. 6

TWO-COMPONENT MIXING PACKAGE

BACKGROUND OF THE INVENTION

1. Field of the Invention

The invention relates to a container for storing two different substances, having a first compartment containing a liquid, a second compartment containing another liquid, a separating body which separates the two compartments, and a tool which breaks the separating body when required and can be moved by hand by means of at least one transmitting part which transmits compression forces.

2. Description of the Prior Art

Containers for storing two different substances are known to a sufficient extent from U.S. Pat. Nos. 4,103,772 and 4,247,001. Such containers, also called two-component packages, are always used whenever two components are required for the application which have to be brought into contact with each other prior to use but, once mixed, lose their effectiveness very quickly. This is the case, for example, with cosmetic preparations, such as hair coloring agents.

A dual container is known from U.S. Pat. No. 4,103,772, which has a main container 2 and an additional container 3, the two flanges of the containers being welded together when the containers have been filled. In this case, the additional container has a deformable top part 5 onto which cutting tools 6 are molded, the elastically deformable top part 5 being arranged in a sealed manner on the terminating skin 10 which can be pushed through.

A two-component package is likewise known from U.S. Pat. No. 4,247,001. This two-component package has a separating film which can be broken by a sharp-edged punching tool when required. In this case, the punching tool lies in one of the containers. The punching tool has resilient elements 16 which center it in the container and guarantee a minimum distance from the separating film when the container has not been deformed. According to the U.S. Patent, the container which receives the punching tool has a region 15 which is shaped in the manner of a concertina and serves to allow the container to be squeezed together in its longitudinal extent when required. In this case, the bottom of the container holding the punching tool presses the punching tool against the separating film, as a result of which the latter is broken.

The disadvantages of the previous solutions are, on the one hand, the complicated connection technique, in which the two containers forming the two-component package are welded together, high temperatures thermally transforming the material of the flanges, as a result of which leakiness often occurs, and, on the other hand, the great force to be applied by the user in order to break the separating film in the container. It is particularly disadvantageous in this case that, in the two solutions previously known, a compression force constantly has to be exerted on the bottom of the container in the direction of the separating film in order to break the separating film.

It is furthermore disadvantageous that the two containers forming the two-component package are welded together. This prevents the containers later being taken apart without breaking them. Reuse of the parts of the two-component package is thus no longer possible. This does not comply with the current requirements for recovery of raw materials.

SUMMARY OF THE INVENTION

The object of the invention is therefore to develop a container for storing two different substances, in which container small compression forces are sufficient in order to break the separating body which separates the two substances. Additionally, the container is to be designed in such a way that as many of its parts as possible can be reused and a high functional reliability is achieved with a compact and simple construction.

According to the invention, this object is achieved in that the transmitting direction of the transmitting part lies at an angle to the direction of movement of the tool, and the transmitting part is rotatably attached by one of its ends to the tool and by its other end to the inside wall of the container.

The advantage of this design lies in the use of the transmitting part designed as a gear mechanism. By pressing the container in laterally, the transmitting part is subjected to pressure by the inside wall of the container, as a result of which the tool is moved in the direction of the separating body.

Owing to the fact that the transmitting part is linked to the inside wall of the container and is held in position by the latter and, furthermore, the tool is held by the transmitting part, the tool is prevented from unintentionally breaking the separating body. It is thus guaranteed that the separating body of the container is only broken when required.

It is particularly advantageous for the transmitting part to be connected to the inside wall of the container by means of a clamping or snap-in connection. It is thus possible to detach the tool from the container without breaking it and to reuse it. An appropriate connection also facilitates the assembly of the dual container.

The force-transmitting parts of the transmitting part should be designed in such a way that they have sufficient resistance to bending and creasing, such that the tool breaks the separating body with targeted deformation of the container.

Advantageously, the transmitting part has joints, in particular film hinges or weakenings in the material, such that it is possible to pivot the transmitting part relative to the container and the tool. In this case, the joints or hinges are recessed into the transmitting part in the region of the contact point with the tool and in the region of the bearing point. By means of these joints, the compression force required for breaking the separating body is reduced further since the adjusting forces of the gear mechanism are reduced.

The transmitting part has a central part, into which an opening to receive the tool is advantageously formed. The tool is connected to the opening of the transmitting part by means of a clamping, snap-in, welded or bonded connection in such a way that the position of the tool inside the container is determined by the transmitting part. For this purpose, the tool has an elongate shank which lies within the opening of the central part of the transmitting part. In this case, the shank has retaining elements which engage from both sides around the edge of the opening of the central part of the transmitting part, as a result of which the tool lies non-displaceably within the opening of the transmitting part.

Advantageously, the central part of the transmitting part is designed as a profiled tube, within which the elongate shank of the tool lies. The direction of movement of the tool is clearly predetermined by the transmitting part due to the profiled tube. Further guiding parts are not necessary in this construction.

The force-transmitting parts of the transmitting part are advantageously arranged in the container in such a way that the axial distance $D_1$ of the connection between the transmitting part and the tool from the separating body is shorter than the axial distance $D_2$ between the bearing point of the transmitting part on the inside wall of the container and the separating body. The direction of movement of the tool is thus clearly predetermined with a targeted deformation of the container. The greater the difference between the axial distances $D_1$ and $D_2$ relative to each other is, the smaller the deformation force to be applied is.

In a further advantageous design, the transmitting part has arms which are molded onto the central part forming the opening, the arms having joints and bearing, at least in some sections, against the inside wall of the container, and the arms engaging with their ends around the elongate shank of the tool and guiding the tool together with the opening of the central part.

By means of the additionally molded-on arms and their ends guiding the tool shank, the tool is guided and tilting of the tool in the container is prevented.

The separating body which seals off the one compartment is advantageously a film, in particular an aluminum foil, which is bonded in a sealing manner or inductively welded to the body forming the compartment. As a result, at least one of the bodies is sufficiently sealed off.

The two vessels forming the two compartments are advantageously held together in a sealing manner by means of at least one clip, the clip having claws, snap-in or clamping connections, such that the clip, when it has been pressed onto the flanges of the vessels, is captively connected thereto. Advantageously, the clip is pressed onto or welded or bonded around the flanges of the vessels. In this case the clip is advantageously made of metal, plastic or aluminum.

The clip can also be replaced by a knurled ring. This results in the two vessels being sealed together particularly well.

In order to achieve an even better sealing-together of the two vessels, a sealing part, in particular a sealing ring, is placed between the two flanges of the vessels and the separating body. In this case, the sealing ring is clamped by the clip or the knurled ring between the flanges of the vessels and thus seals off the openings of the vessels sufficiently.

The bottom of the vessel which receives the tool is advantageously fitted with an intended creasing point or an intended creasing groove, such that the bottom can preferably crease inwards in the axial direction when the side walls of the vessel are squeezed together transversely to the direction of movement of the tool. Owing to the provision of an intended creasing point, the compression force to be applied to deform the container is likewise further reduced. The force to be raised can be reduced considerably by the use of an easily deformable plastic.

Exemplary embodiments of the invention are illustrated in the drawings and explained in greater detail below.

BRIEF DESCRIPTION OF THE DRAWING

FIG. 3 shows a fitted-together container, having a transmitting part and a tool.

FIG. 3*a* shows an enlarged view of a portion of FIG. 3.

FIG. 4 shows a transmitting part, having a profiled tube and snap-in connections to the inside wall of the housing.

FIG. 5 shows a transmitting part, having a profiled tube and weakened points in the material of the arms designed as joints.

FIG. 6 shows a transmitting part, having arms which guide the shank of the tool.

DETAILED DESCRIPTION

Figure 1:
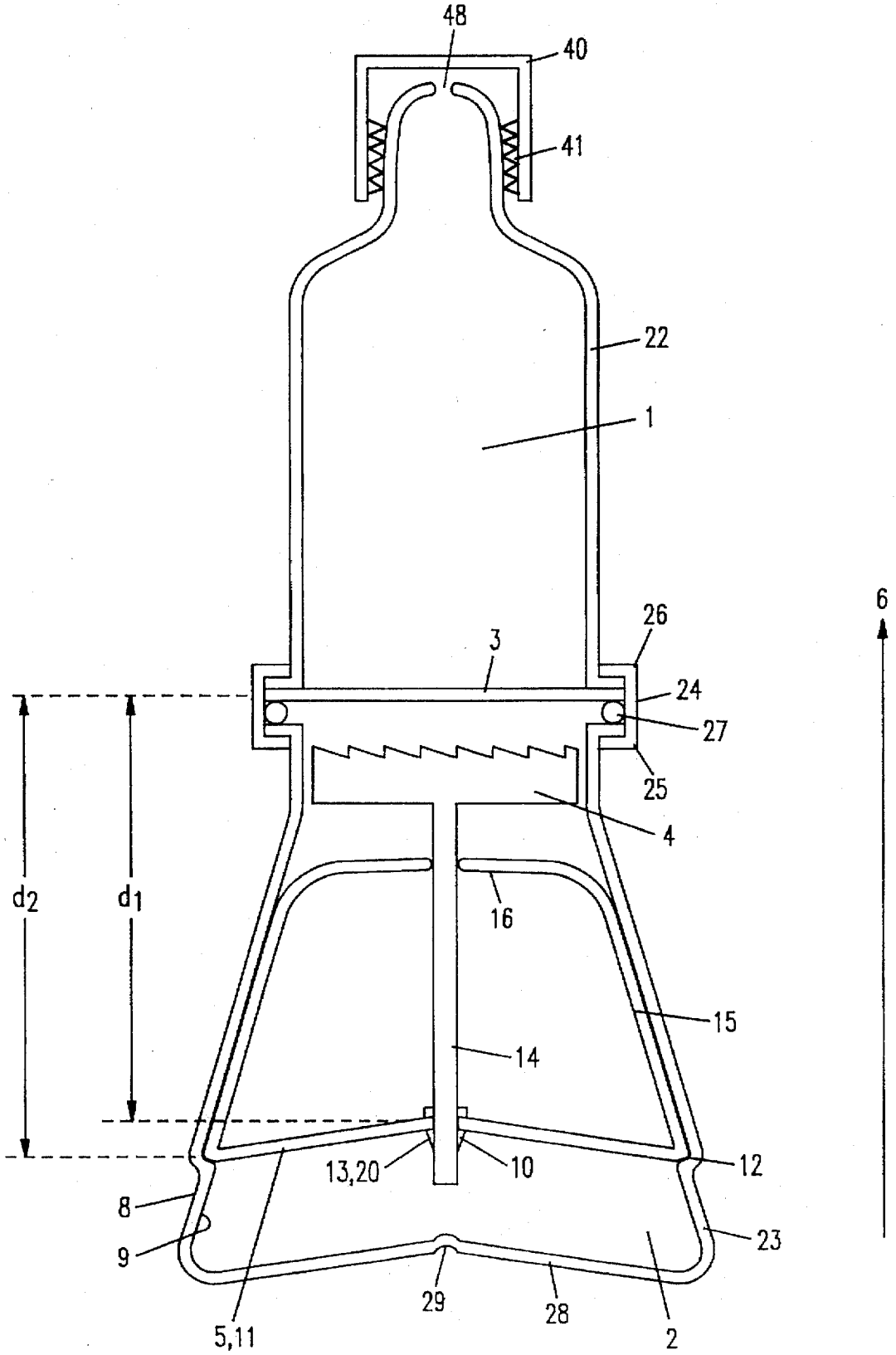
FIG. 1 shows a container for storing two different substances, having a transmitting part.

FIG. 1 shows a container for storing two different substances, having a vessel 1 containing a first liquid and a second vessel 2 for receiving a second liquid. As shown for example in FIG. 1, the container of this invention also includes, if desired, a cover or cap 40, together with threads 41 for securing cap 40 to vessel 22, covering opening 48. Lying within the vessel 2 is a transmitting part 5 which holds the shank 14 of a tool 4 in position. In this case, the shank 14 of the tool 4 lies within the opening 13 of the transmitting part 5 and is simultaneously guided by the ends 16 of the arms 15 molded onto the transmitting part 5. The transmitting part 5 lies in the inside wall 9 of the container in a recess 12 which surrounds the transmitting part 5. In this case, the diameter of the vessel 2 tapers, beginning at the recess 12, toward the opening of the vessel 2, such that the transmitting part 5 lying within it is clamped by its arms 15 in the container 2 in such a way that it cannot be displaced itself in the container 2. The arms 15 of the transmitting part 5 are shaped in such a way that they bear against the inside wall of the vessel, from the bearing point 12 over a certain path, and are pressed by said inner wall with their ends 16 against the elongate shank 14 of the tool 4.

Molded onto the tool shank 14 are retaining elements 10 which surround the edge of the opening 13 of the transmitting part 5 from the top and bottom, as a result of which the tool 4 is held by the transmitting part 5 in the direction of movement 6.

The transmitting part 5 is arranged in the container in such a way that the arms 11 of the transmitting part 5 lie at an angle to the direction of movement 6 of the tool 4. In this case, the axial distance $D_1$ from the opening 13 of the transmitting part 5 toward the separating body 3 is to be shorter than the distance $D_2$ from the bearing point 12 of the transmitting part 5 toward the separating body 3. It is thus guaranteed that, when the container is squeezed together laterally in the region of the recess 12, the inside wall 9 of the container subjects the transmitting part 5 to pressure in such a way that the force-transmitting arms 11 act upon the shank 14 of the tool 4 with a force which drives the tool in the direction of movement 6, as a result of which the separating body 3 is broken.

The connection of the transmitting part 5 to its opening 13 and the shank 14 of the tool 4 is designed as a joint or hinge, thus allowing the arms 11 of the transmitting part 5 to be pivoted relative to the elongate shank 14 of the tool 4. Additionally, the arms 11 of the transmitting part 5 likewise have joints or hinges in the region of the recess 12, such that the arms 11 of the transmitting part 5 can be pivoted relative to the arms 15 of the transmitting part 5 bearing against the inside wall 9 of the container with targeted deformation of the container.

The bottom 28 of the vessel 23 is shaped inwards and has an intended creasing point 29 which guarantees that the bottom 28 can easily be pivoted inward when the container is squeezed together.

The vessels 22 and 23 forming the two compartments 1 and 2 have flanges 25, 26. In this case, the one vessel is welded or bonded to the one flange of a vessel by means of a separating body, in particular a separating foil made of aluminum. Placed between the separating foil and the flange of the other vessel is a sealing part, in particular a sealing ring. The two flanges of the vessels 22 and 23 are pressed against each other by means of a clip. For this purpose, the clip is pressed on, beaded or bonded around the flanges 25 and 26. By means of this design, the vessel connection is sufficiently sealed off.

In a design which is not illustrated, the vessel 23 may be a cylindrical body, in which case, however, it must be guaranteed that the transmitting part 5 is anchored in the inside wall 9 of the vessel 23 in such a way that the transmitting part 5 holding the tool cannot be displaced back and forth in the direction of movement 6 of the tool.

Figure 2:
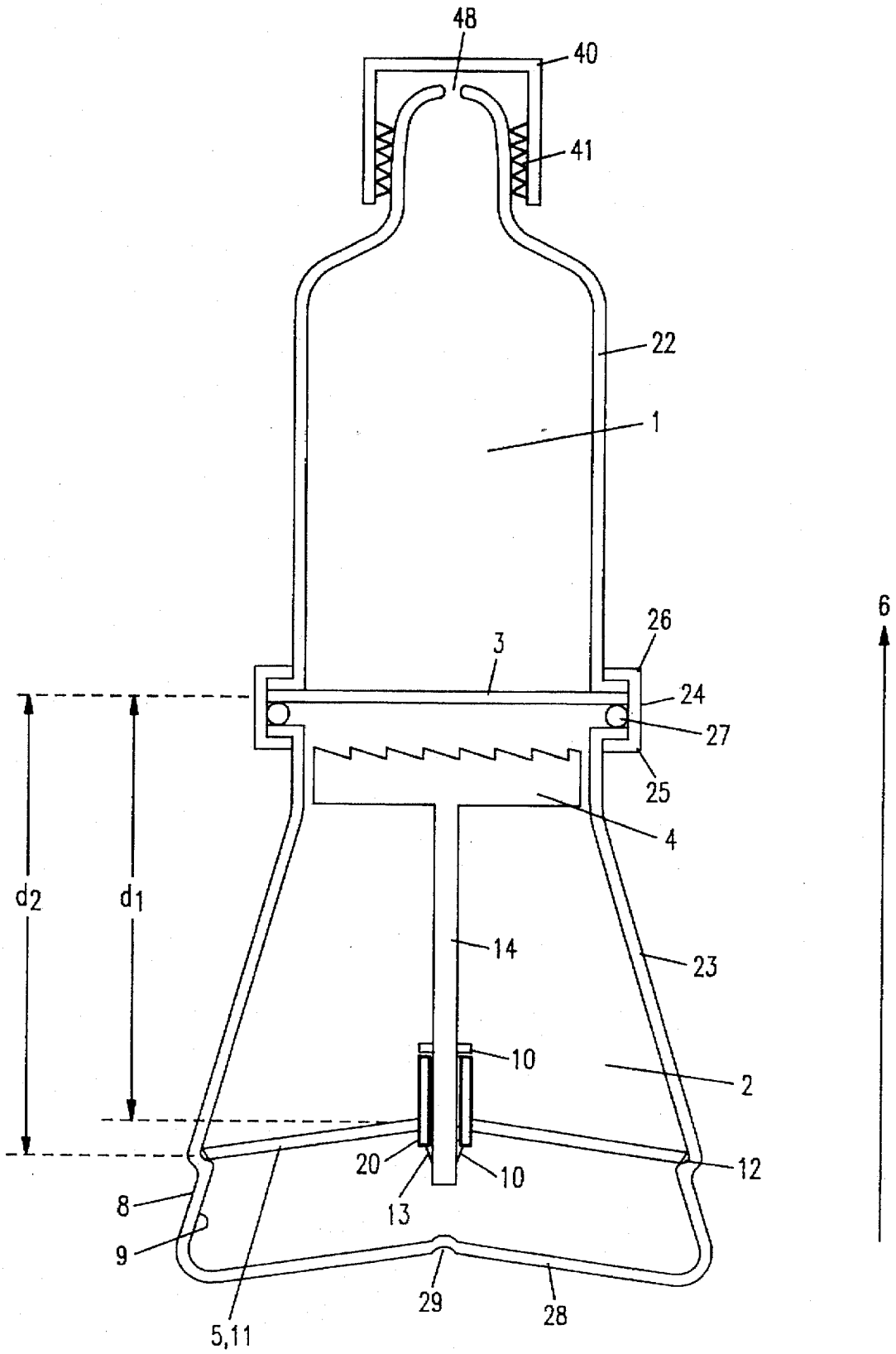
FIG. 2 shows a container for storing two different substances, having a transmitting part, said transmitting part having a profiled tube.

FIG. 2 illustrates a container for storing two different substances, which container differs from the container illustrated in FIG. 1 in that the transmitting part 5 is of a different design. The transmitting part 5 illustrated in FIG. 2 has a central part 20 which is a profiled tube and has an opening 13 to receive the shank 14 of the tool 4. Owing to the design of the central part 20 as an elongate profiled tube, the arms 15 of the transmitting part 5 designed as spring bars can be dispensed with. Sufficient guiding of the tool 4 is provided by the elongate profiled tube 20. Between the profiled tube 20 and the arms 11 of the transmitting part 5, there are advantageously joints or hinges which are formed by weak material or weakenings in the material. The ends of the arms 11 of the transmitting part 5 connected to the-recesses 12 can be designed as snap-in, press-on or clamping connections.

FIG. 3 (and the enlarged portion shown in FIG. 3*a*) illustrates a container for storing two different substances, the one container 23 lying partly within the container 22. The container 23 is closed in a sealing manner by means of a separating film 3.

The container 22 is illustrated as a cylindrical body. The vessels 23 and 22 have flanges 25 and 26, the flange 26 of the vessel 22 being attached to the open side of the vessel 22 and the flange 25 being attached to the bottom plate of the vessel 23. The lengths of the flanges are dimensioned such that they terminate with each other on their outer side. A sealing ring 27 lies between the flanges 25, 26. The flanges 25, 26 are held together in a sealing manner by a knurled ring 24.

The bottom plate 23*a* of the vessel 23 has an opening nozzle 43 which is closed by a lock 42 which can be broken off. By breaking off the part 42, the lock can emerge from the dual container together.

In the vessel 22 illustrated in FIG. 3, the transmitting element 5 is firmly anchored in the vessel by means of a snap-in connection illustrated on an enlarged scale. The tool 4 lies with its elongate shank 14 within the opening 13 of the elongate profiled tube 20.

FIGS. 4 and 5 illustrate transmitting parts 5. The transmitting part 5 illustrated in FIG. 4 has arms 11 whose ends are designed as balls 17 which are pressed into spherical recesses 12. The recess 12 and the ball head 17 of the arms 11 are dimensioned as a snap-in connection, the dimensions being such that the arm 11 attached to the ball head 17 can be pivoted. In this case, the elongate profiled tube 20, which also includes a top edge 20*a* and a bottom edge 20*b*, is connected to the arm 11 by means of a hinge 30 designed as a film hinge.

FIG. 5 illustrates a similar transmitting part 5 to that illustrated in FIG. 4, the ball heads 17 of the arms 11 now being of rectangular shape and lying in a positive-locking manner within the recesses 12 of the inside wall of the container.

Owing to the fact that the rectangular parts 17 can no longer be turned in the recesses 12, additional joints or hinges 31 are formed between the arms 11 and the rectangular parts 17, such that the arms 11 can be pivoted relative to their rectangular parts 17.

FIG. 6 shows a transmitting part 5 having a central part 20 which has an opening 13, the arms 11 being movably connected to the central part 20 via hinges. Molded onto the ends of the arms 11 which lie within the recesses 12 of the inside wall 9 of the container are arms 15 which are shaped at their ends 16 to correspond to the shape of the elongate shank 14 of the tool 4 in such a way that the ends 16 guide the tool 4.

In a design which is not illustrated, the transmitting part 5 can have more than two arms 11, of which all or only some are supported in recesses 12 On the inside wall 9 of the container.

I claim:

1. A container for separately packaging two different substances and for enabling mixing of said substances prior to dispensing thereof from said container, comprising:

a first compartment containing first substance and a second compartment containing a second substance;

a frangible seal separating said first and second compartments;

a discharge port for enabling discharge from at least one of said compartments of a mixture of said substances; and a puncturing device for breaking said frangible seal to establish a communication between said compartments, said puncturing device comprising a toggle lever press comprising lateral lever arms and a press shank having a die with a sharp knife edge adjacent said frangible seal, and being contained within one of said compartments in a guided manner to break frangible seal upon application of a force against said lateral lever arms by laterally squeezing said compartment containing said puncturing device to push said press shank in the direction of said frangible seal allowing said sharp knife edge to break said frangible seal, said lever arms having joints, in the form of film hinges or weakings in the material forming said lever arms, such that said lever arms can be pivoted relative to said press shank.

2. A container for separately packaging two different substances and for enabling mixing of said substances prior to dispensing thereof from said container, comprising:

a first compartment containing a first substance and a second compartment containing a second substance;

a frangible seal separating said first and second compartments;

a discharge port for enabling discharge from at least one of said compartments of a mixture of said substances; and a puncturing device for breaking said frangible seal to establish a communication between said compartments, said puncturing device comprising a toggle lever press comprising lateral lever arms and a press shank having a die with a sharp knife edge adjacent said frangible seal, and being contained within one of said compartments in a guided manner to break said frangible seal upon application of a force against said lateral lever arms by laterally squeezing said compartment containing said puncturing device to push said press shank in the direction of said frangible seal allowing said sharp knife edge to break said frangible seal, said lever arms being connected to a tube, in which said press shank is guided.

3. The container according to claims 1 or 2, wherein said lever arms each comprise a free end, respectively, which lies firm within a recess in an inside wall of said compartment containing said puncturing member.

4. The container according to claims 1 or 2, wherein said frangible seal comprises a film, which is bonded in a sealing manner to a body forming said compartment.

5. The container according to claim 4, wherein said film comprises an aluminum foil.

6. A container according to claim 4, wherein said film is bonded in said sealing manner by inductive welding.

7. The container according to claims 1 or 2, wherein said two compartments have flanges to hold them together by a least one clip, said clip having an attachment selected from claws, snap-in, and clamping connections, such that the clip, when it has been pressed onto the flanges, is captively connected thereto.

8. The container according to claim 7, wherein said frangible seal lies between said flanges.

9. The container according to claims 1 or 2, wherein a bottom of said compartment containing said puncturing device includes a creasing line in order to yield when lateral walls of said compartment are squeezed together.

* * * * *